US007669986B2

(12) United States Patent
Shimura

(10) Patent No.: US 7,669,986 B2
(45) Date of Patent: Mar. 2, 2010

(54) DROPLET DISCHARGING HEAD AND DROPLET DISCHARGING DEVICE, AND DISCHARGING CONTROL METHOD

(75) Inventor: Yasuto Shimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 316 days.

(21) Appl. No.: 11/763,074

(22) Filed: Jun. 14, 2007

(65) Prior Publication Data

US 2008/0018678 A1 Jan. 24, 2008

(30) Foreign Application Priority Data

Jul. 20, 2006 (JP) ..... 2006-198045

(51) Int. Cl.
*B41J 2/045* (2006.01)

(52) U.S. Cl. ..... 347/68

(58) Field of Classification Search ..... 347/68, 347/69–72, 61–65, 54–56, 44, 46–47, 84, 347/87, 20, 14–15, 9; 400/124.16; 29/890.1
See application file for complete search history.

(56) References Cited

U.S. PATENT DOCUMENTS 6,336,697 B1 1/2002 Fukushima
7,169,537 B2 1/2007 Miura et al.
2007/0052754 A1 3/2007 Amako et al.
2008/0189947 A1 * 8/2008 Ohta ..... 29/890.1

FOREIGN PATENT DOCUMENTS

| | | |
|---|---|---|
| JP | A 07-125220 | 5/1995 |
| JP | A-09-300611 | 11/1997 |
| JP | A 09-300626 | 11/1997 |
| JP | A 10-235869 | 9/1998 |
| JP | A 11-058746 | 3/1999 |
| JP | A 2001-187453 | 7/2001 |
| JP | A 2002-001951 | 1/2002 |
| JP | A-2002-210945 | 7/2002 |
| JP | A-2005-007654 | 1/2005 |
| WO | WO 99/38694 | 8/1999 |

* cited by examiner

*Primary Examiner*—K. Feggins
(74) *Attorney, Agent, or Firm*—Oliff & Berridge, PLC

(57) ABSTRACT

A droplet discharging head includes a nozzle supplied with a liquid substance, a meniscus moving section that moves a meniscus of the liquid substance in the nozzle, and a meniscus regulating section that is provided to an inside wall of the nozzle at a predetermined depth from an opening of the nozzle and regulates movement of an edge of the meniscus in the nozzle at the depth.

8 Claims, 6 Drawing Sheets

DROPLET DISCHARGING HEAD AND DROPLET DISCHARGING DEVICE, AND DISCHARGING CONTROL METHOD

BACKGROUND OF THE INVENTION

1. Technical Field

Several aspects of the present invention relate to a droplet discharging device such as an inkjet recording device, a display manufacturing apparatus, an electrode forming apparatus, or a biochip manufacturing apparatus, and a droplet discharging head implemented in the droplet discharging device, and an discharging control method thereof.

2. Related Art

In recent years, droplet discharging heads (heads) for discharging a liquid as a droplet from a microscopic nozzle have been widely used for printing or other industrial applications. For example, the head disclosed in JP-A-2002-1951 is equipped with a piezoelectric element for varying the capacity of a chamber connecting to a nozzle, and the amount and the velocity (discharging characteristics) of the droplet to be discharged can be precisely controlled (discharging control) by an electric signal (drive signal) to be added to the piezoelectric element.

The above discharging control mentioned is performed by moving the surface of the liquid (meniscus) forward (movement thereof towards the opening of the nozzle) or backward (movement thereof towards the liquid chamber) in accordance with up and down of the voltage applied to the piezoelectric element by the drive signal. In this case, if the repeatability of the meniscus position inside the nozzle to the drive signal is poor, it's discharging characteristics is problematically varied every discharging, and accordingly, it is preferable to pay sufficient attention to this point in order for achieving stability of the discharging characteristics.

SUMMARY

In view of the above problems, the invention has an advantage of providing a droplet discharging head, a droplet discharging device, and a discharging control method therefor in which attention is paid to the stability of the discharging characteristics.

A droplet discharging head according to an aspect of the invention includes a nozzle supplied with a liquid substance, a meniscus moving section that moves a meniscus of the liquid substance in the nozzle, and a meniscus regulating section that is provided to an inside wall of the nozzle at a predetermined depth from an opening of the nozzle and regulates movement of an edge of the meniscus in the nozzle at the depth.

According to the droplet discharging head of this aspect of the invention, the discharging characteristic can be superior in stability, since the droplet can be discharged after the edge of the meniscus is moved to the position with the depth in the nozzle in accordance with the meniscus regulating section with a good repeatability in the discharging control.

Further, in the droplet discharging head described above, it is preferable that the meniscus regulating section is disposed along an inside circumferential direction of the nozzle.

According to the droplet discharging head of this aspect of the invention, since the meniscus regulating section is disposed along the inside circumferential direction of the nozzle, the movement of the edge of the meniscus can be regulated in an isotropic manner, thus no bad influence is given to the shape of the meniscus.

Further, in the droplet discharging head described above, it is preferable that the meniscus regulating section includes a recess section or a protruding section provided to an inside wall of the nozzle.

According to the droplet discharging head of this aspect of the invention, the advantage described above can efficiently be obtained even with the meniscus regulating section having a simple configuration.

Further, in the droplet discharging head described above, it is preferable that the meniscus regulating section includes a lyophobic area provided to an inside wall of the nozzle.

According to the droplet discharging head of this aspect of the invention, the advantage described above can efficiently be obtained even with the meniscus regulating section having a simple configuration.

Further, in the droplet discharging head described above, it is preferable that the meniscus regulating section includes a first meniscus regulating section, and a second meniscus regulating section disposed at a different depth from the first meniscus regulating section.

According to the droplet discharging head of this aspect of the invention, by the discharging control of discharging the droplet after moving the edge of the meniscus to the position with the depth in accordance with the first meniscus regulating section and the discharging control of discharging the droplet after moving the edge of the meniscus to the position with the depth in accordance with the second meniscus regulating section, it becomes possible to discharge the droplets in accordance with different discharging characteristics from a single droplet discharging head. Further, by providing a plurality of droplet discharging heads, further delicate control can be achieved.

A droplet discharging head according to another aspect of the invention includes an discharging surface provided to a base, a liquid cavity, and a through hole that is provided to the base and connects the discharging surface and the liquid cavity, wherein the through hole includes a first section bordering the discharging surface and a second section bordering the liquid cavity, a circular meniscus regulating section is provided to an inside wall of the first section, and the meniscus regulating section one of protrudes from and is recessed in the inside wall of the first section in the middle from the discharging surface. According to this aspect, the repeatability of the shape of the edge of the meniscus can be improved.

A droplet discharging device according to another aspect of the invention includes the droplet discharging head, and an discharging control section that controls the meniscus moving section to discharge a droplet from the nozzle, wherein the discharging control section performs a step A of moving the edge of the meniscus towards the inside of the nozzle to the depth in accordance with the meniscus regulating section, and a step B of discharging the droplet by moving the meniscus towards the opening of the nozzle after the step A.

According to the droplet discharging device of this aspect of the invention, since the droplet can be discharged after the edge of the meniscus is moved (step A) to the position with the depth in the nozzle in accordance with the meniscus regulating section with a good repeatability, the discharging characteristic superior in stability can be obtained.

A droplet discharging device according to another aspect of the invention includes the droplet discharging head having a first and a second meniscus regulating sections, and an discharging control section that controls the meniscus moving section to discharge a droplet from the nozzle, wherein the discharging control section includes a first control mode for performing a step A1 of moving the edge of the meniscus towards the inside of the nozzle to the depth in accordance with the first meniscus regulating section, and a step B1 of discharging the droplet by moving the meniscus towards the opening of the nozzle after the step A1, and a second control mode for performing a step A2 of moving the edge of the meniscus towards the inside of the nozzle to the depth in accordance with the second meniscus regulating section, and a step B2 of discharging the droplet by moving the meniscus towards the opening of the nozzle after the step A2.

According to the droplet discharging device of the aspect, the discharging characteristic can be superior in stability, since the droplet can be discharged after the edge of the meniscus is moved (step A1/step A2) to the positions with the depths in the nozzle in accordance with the first and the second meniscus regulating sections with a good repeatability. Further, by using the first control mode and the second control mode separately according to the cases, the droplets according to different discharging characteristics can be discharged from a single droplet discharging head.

A method of controlling discharging of a droplet according to another aspect of the invention includes the steps of moving an edge of a meniscus towards the inside of a nozzle to the depth in accordance with a meniscus regulating section that is provided to an inside wall of the nozzle at a predetermined depth from an opening of the nozzle and regulates movement of the edge of the meniscus in the nozzle at the depth, and discharging the droplet by moving the meniscus towards the opening of the nozzle after the step of moving the edge of the meniscus.

According to the method of discharging a droplet of the aspect, the discharging characteristic can be superior in stability since the droplet can be discharged after the edge of the meniscus is moved to the position with the depth in the nozzle in accordance with the meniscus regulating section with a good repeatability.

BRIEF DESCRIPTION OF THE DRAWINGS

The invention will now be described with reference to the accompanying drawings, wherein like numbers refer to like elements.

DESCRIPTION OF THE EMBODIMENTS

Hereinafter, a preferred embodiment of the invention will be described in detail with reference to the accompanying drawings.

It should be noted that although the embodiments described below, which are preferable specific examples of the invention, are provided with various limitations technically preferable, the scope of the invention is not limited to these embodiments unless the description to limit the invention thereto is particularly presented in the following explanations. Further, the drawings referred to in the following explanations show some cases in which members or portions are shown with the different horizontal to vertical ratio from the actual ratio for the sake of illustration.

First Embodiment

Droplet Discharging Device

Firstly, the configuration of the droplet discharging device will be explained with reference to FIGS. 1, 2, and 3.

Figure 1:
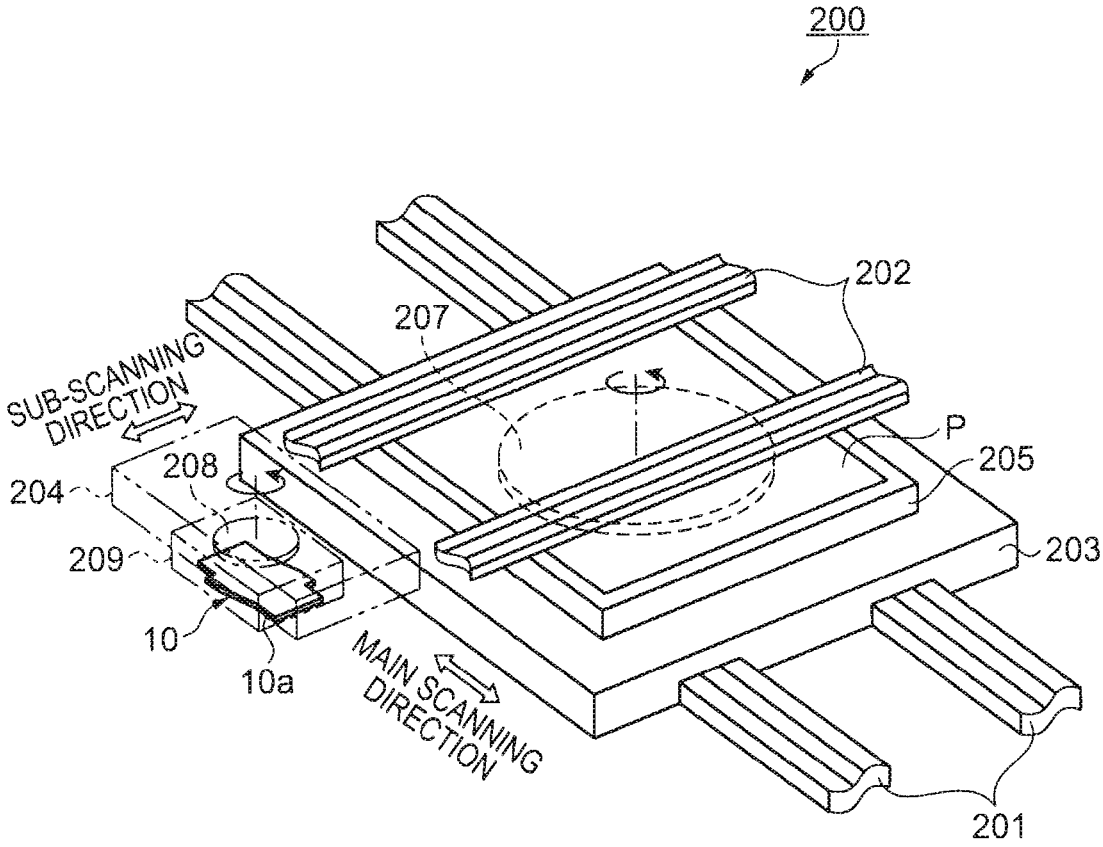
FIG. 1 is a perspective view showing a substantial configuration of a droplet discharging device.

FIG. 1 is a perspective view showing the substantial configuration of the droplet discharging device. FIG. 2 is a cross-sectional view showing the substantial configuration of a droplet discharging head. FIG. 3 is a diagram showing the electrical configuration of the droplet discharging device.

As shown in FIG. 1, a droplet discharging device 200 is provided with a pair of guide rails 201 disposed linearly and a main scanning movable stage 203 moving in the main scanning direction by air sliders and linear motors (not shown) disposed inside the guide rails 201. Further, the droplet discharging device 200 is provided with a pair of guide rails 202 disposed linearly so as to be perpendicular to the guide rails 201 above the guide rails 201 and a sub-scanning movable stage 204 moving along the sub-scanning direction by air sliders and linear motors (not shown) disposed inside the guide rails 202.

On the main scanning movable stage 203 there is disposed a stage 205 for mounting a substrate P to be an discharging object. The stage 205 has a configuration capable of absorbing to fix the substrate P, and further, is configured to allow accurate adjustment of the reference axes in the substrate P to the main scanning direction and the sub-scanning direction with a rotary mechanism 207.

The sub-scanning movable stage 204 is provided with a carriage 209 attached thereto in a pendant manner via a rotary mechanism 208. Further, the carriage 209 is provided with a head unit 10 having discharging surface 10*a* for a liquid substance facing towards the substrate P, a liquid substance supplying mechanism (not shown) for supplying the head unit 10 with the liquid substance, and a control circuit board 211 (see FIG. 3) for performing electrical control of the head unit 10.

Figure 2:
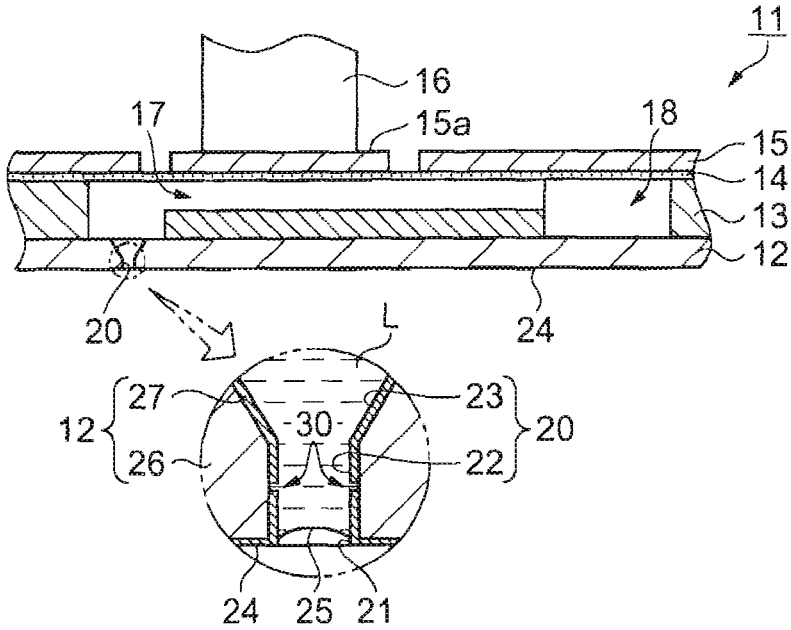
FIG. 2 is a cross-sectional view showing a substantial configuration of a droplet discharging head.

The head unit 10 is configured combining a plurality of droplet discharging heads 11 shown in FIG. 2. The droplet discharging head 11 is composed by stacking a nozzle plate 12 having nozzles 20 formed on one surface thereof to have a predetermined arrangement, a channel plate 13 provided with grooves to form flow paths connecting to the nozzles 20, a flexible film 14, and an upper cover plate 15 having an island section 15*a* separated partially. Either of these plates can be integrated with another.

The nozzle plate 12 has a base plate 26 provided with through holes corresponding to the nozzles 20 and a surface layer 27 formed on the surface of the base plate 26. Further, a silicon substrate is used as the channel plate 13, a resin film is used as the flexible film 14, and a SUS plate is used as the upper cover plate 15.

The head unit 10 is provided with cavities 17 as liquid chambers connected to the respective nozzles 20 and a reservoir 18 as a reserving chamber of the liquid substance provided commonly to the plurality of cavities 17. Further, the liquid substance L supplied to the reservoir 18 via a flow channel not shown is supplied from the reservoir 18 to each of the cavities 17 and then to each of the nozzles 20. Inside each of the nozzles 20 supplied with the liquid substance L, a curved meniscus 25 is formed.

The nozzle 20 includes a first section bordering an opening surface 24 (discharging surface) and a second section bordering the liquid chamber, and has a straight section 22 formed linearly from the nozzle opening 21 as the first section and a tapered section 23 formed to have a tapered shape continuously to the straight section 22 as the second section. In the present embodiment, the inside diameter of the straight section is set to be 10 μm, the length thereof is set to be 20 μm, and the angle of spread of the taper section 23 is set to be 45 degrees. On the inside surface of the straight section 22, there is provided a recess section 30 as a meniscus regulating section formed as an area from which the surface layer 27 is eliminated. The recess section 30 according to the present embodiment is formed in a circular manner at the depth of 10 μm from the nozzle opening 21 along the inside circumferential direction of the straight section 22, and has a depth (corresponding to the thickness of the surface layer 27) of 1 μm.

On the opening surface 24 provided with the nozzle openings 21, there is formed a lyophobic film (not shown). As the lyophobic film, for example, a film (a self-assembly film) formed of chemical compound molecules having a lyophobic functional group such as fluoroalkylsilane bound each other on the opening surface 24 in an assembled condition, a coating formed as eutectoid (eutectic) of fluorocarbon resin, and so on can be used. This lyophobic plays a role of preventing the case that formation of the normal meniscus 25 is disturbed by the liquid substance adhering to the opening surface 24 spreading to wet around the nozzle opening 21.

In the upper cover section of the cavity 17, one end of the piezoelectric element 16 as meniscus moving means is bonded to the island section 15*a* movably disposed via the flexible film 14. As described above, by performing the control of the capacity and the liquid pressure in the cavity 17 by driving the piezoelectric element 16, the behavior (the shape and the position) of the meniscus 25 can be controlled. It should be noted that driving of the piezoelectric element 16 is performed by an electrical signal (hereinafter referred to as a drive signal) applied to the electrodes (not shown) of the piezoelectric element 16.

Figure 3:
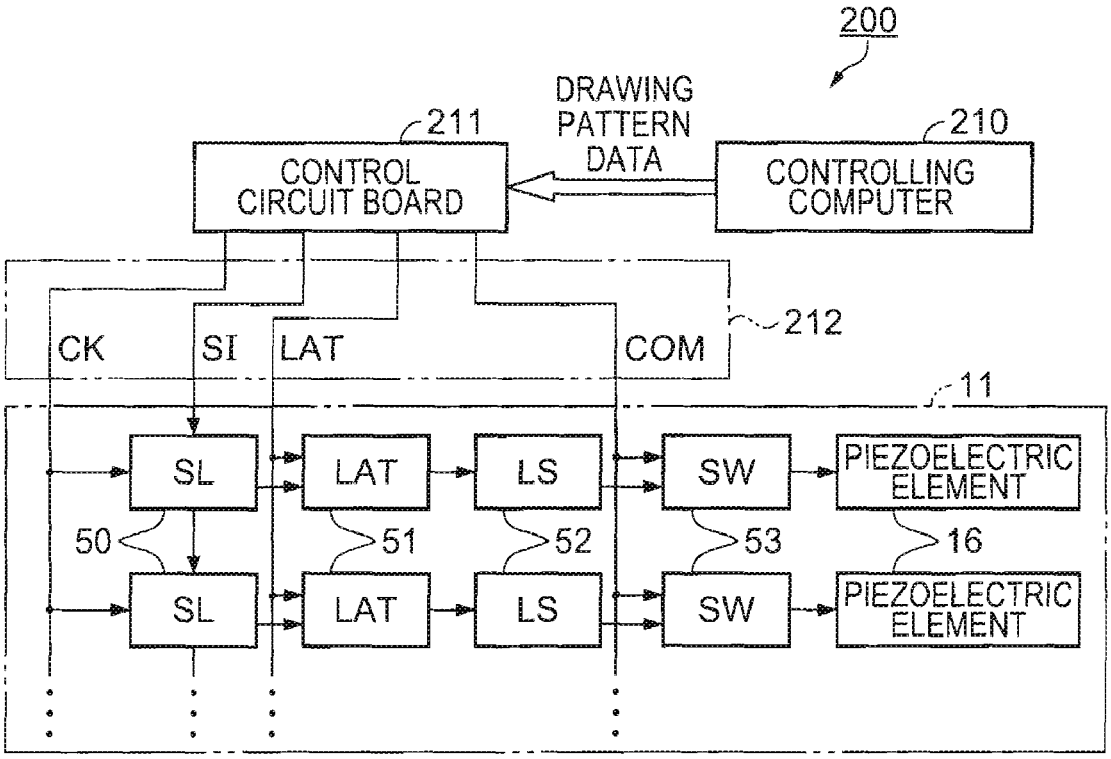
FIG. 3 is a diagram showing an electrical configuration of the droplet discharging device.

In FIG. 3, the droplet discharging device 200 is provided with a control computer 210 for performing overall control of the whole device and a control circuit board 211 as discharging control means for performing electrical control of the droplet discharging head 11. The control circuit board 211 is electrically connected to the droplet discharging head 11 via a flexible cable 212. Further, the droplet discharging head 11 is equipped with shift registers (SL) 50, latch circuits (LAT) 51, level shifters (LS) 52, and switches (SW) 53 corresponding to the piezoelectric elements 16 each provided to the respective one of the nozzles 20 (see FIG. 2).

In response to the control computer 210 transmitting to the control circuit board 211 the drawing pattern data of the bitmap format representing the arrangement of the droplets on the substrate P (see FIG. 1), the control circuit board 211 decodes the drawing pattern data to generate the nozzle data as ON/OFF (discharging/non-discharging) information for each of the nozzles 20. Then the nozzle data is formed as a serial signal (SI) and transmitted to each of the shift registers 50 in sync with the clock signal (CK).

The nozzle data transmitted to the shift registers 50 is latched with the timing with which the latch signal (LAT) is input to the latch circuit 51, and further, converted to a gate signal for the switch 53 by the level shifter 52. Specifically, when the nozzle data is "ON," the switch 53 opens to supply the piezoelectric element 16 with the drive signal (COM), and when the nozzle data is "OFF," the switch 53 is closed, and no drive signal (COM) is supplied to the piezoelectric element 16. Further, in the nozzle 20 corresponding to the "ON" state, the control (hereinafter referred to as discharging control) of the meniscus 25 (see FIG. 2) in accordance with the drive signal (COM) is performed, thus the liquid substance L (see FIG. 2) is discharged as a droplet.

In the configuration described above, the head unit 10 is moved (scanning) relatively with respect to the substrate P in the main scanning direction and the sub-scanning direction in the condition in which the relationship between the scanning direction and the arrangement direction of the nozzles 20 is accurately determined by the rotary mechanism 208. Further, the droplets are discharged from the nozzles 20 of the droplet discharging head 11 with appropriate timing in sync with the scanning by the head unit 10. Thus, it becomes possible to dispose the liquid substance at desired positions on the substrate P by a minute amount thereof. It should be noted that as the liquid substance, a liquid such as water or organic solvent, or various functional materials (e.g., metals, semiconductors, color materials, organic EL materials) dispersed or dissolved in such a liquid can be adopted in accordance with the usage.

Method of Manufacturing Nozzle Plate

Then, a method of manufacturing the nozzle plate will be explained with reference to FIGS. 4A through 4D.

FIGS. 4A through 4D are cross-sectional views showing a manufacturing process of the nozzle plate.

Figure 4A:
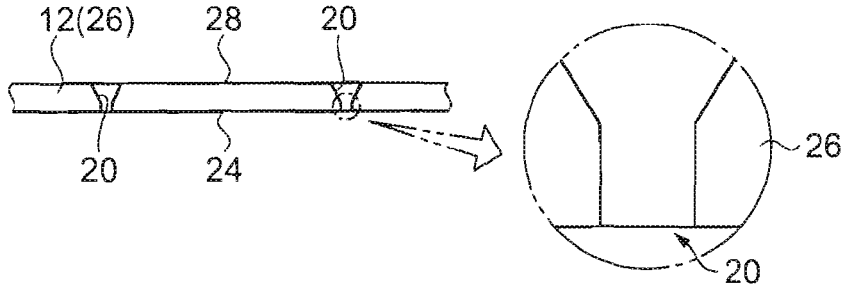
FIGS. 4A through 4D are cross-sectional views showing a manufacturing process of a nozzle plate.

Firstly, as shown in FIG. 4A, through holes to form the nozzles 20 are provided to the base plate 26 to be the base of the nozzle plate 12. Specifically, the through holes can be provided to the base plate 26 made of metal (e.g., SUS) by a mechanical processing technology using a punching tool, the base plate 26 made of silicon by a known semiconductor processing technology, or the base plate 26 made of resin using a known laser processing technology and so on.

Figure 4B:
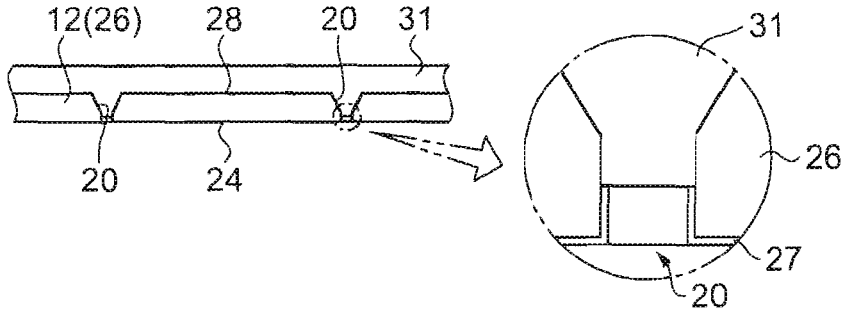

Subsequently, as shown in FIG. 4B, a resist film 31 is adhered to a taper surface 28 side of the nozzle plate 12, and the resist film 31 is inserted in the nozzles 20 to a predetermined depth by applying appropriate heat and pressure. Then, after forming the surface layer 27 on the exposed surface of the base plate 26, the resist film 31 is removed. The surface layer 27 can be formed using, for example, a plating method, a sputtering method, or the like, and as the material therefor, metals, semiconductors, or oxides thereof can widely be used.

Figure 4C:
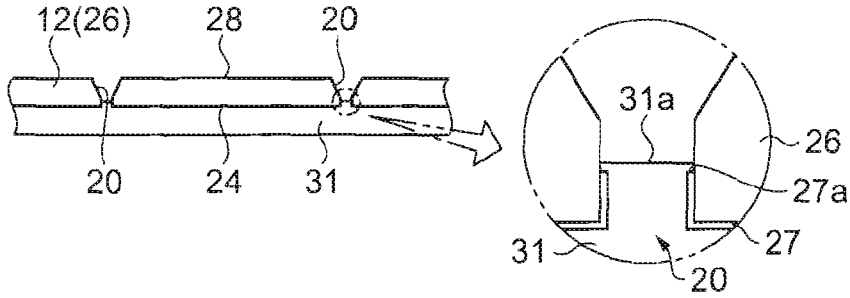

Subsequently, as shown in FIG. 4C, the resist film 31 is adhered to the opening surface 24 side of the nozzle plate 12, and the resist film 31 is inserted in the nozzles 20 to a predetermined depth by applying appropriate heat and pressure. In this case, an edge 31*a* of the resist film 31 is inserted to a little bit deeper position than the edge 27*a* of the surface layer 27 formed in the previous step.

Figure 4D:
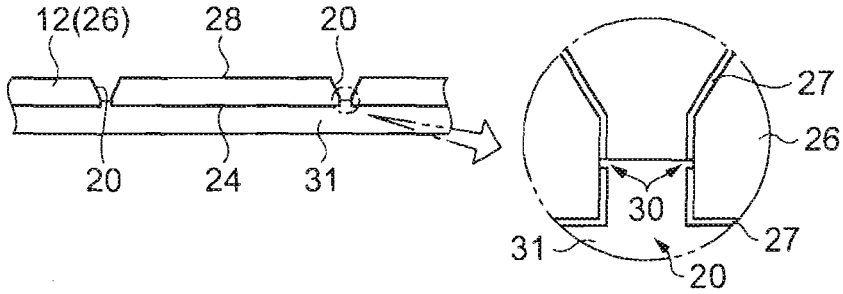

Subsequently, as shown in FIG. 4D, the surface layer 27 is formed on the exposed surface of the base plate 26, and then the resist film 31 is removed. Thus, the recess section 30 is formed in each of the nozzles 20 as the area on which the surface layer 27 has not been formed. After then, the lyophobic film is provided to the opening surface 24 using the method as described above, thus the nozzle plate 12 is completed.

It should be noted that by repeating the control of the amount of insertion of the resist film 31 described above and the selective formation and etching of the surface layer 27, a plurality of recess sections 30 can also be formed at different depth positions. Further, as another method of forming the recess section 30, the plating method performed while precisely controlling the dipping depth in the plating liquid can also be considered.

Discharging Control Method

Then, the discharging control method for the droplet discharging head will be explained with reference to FIG. 5.

Figure 5:
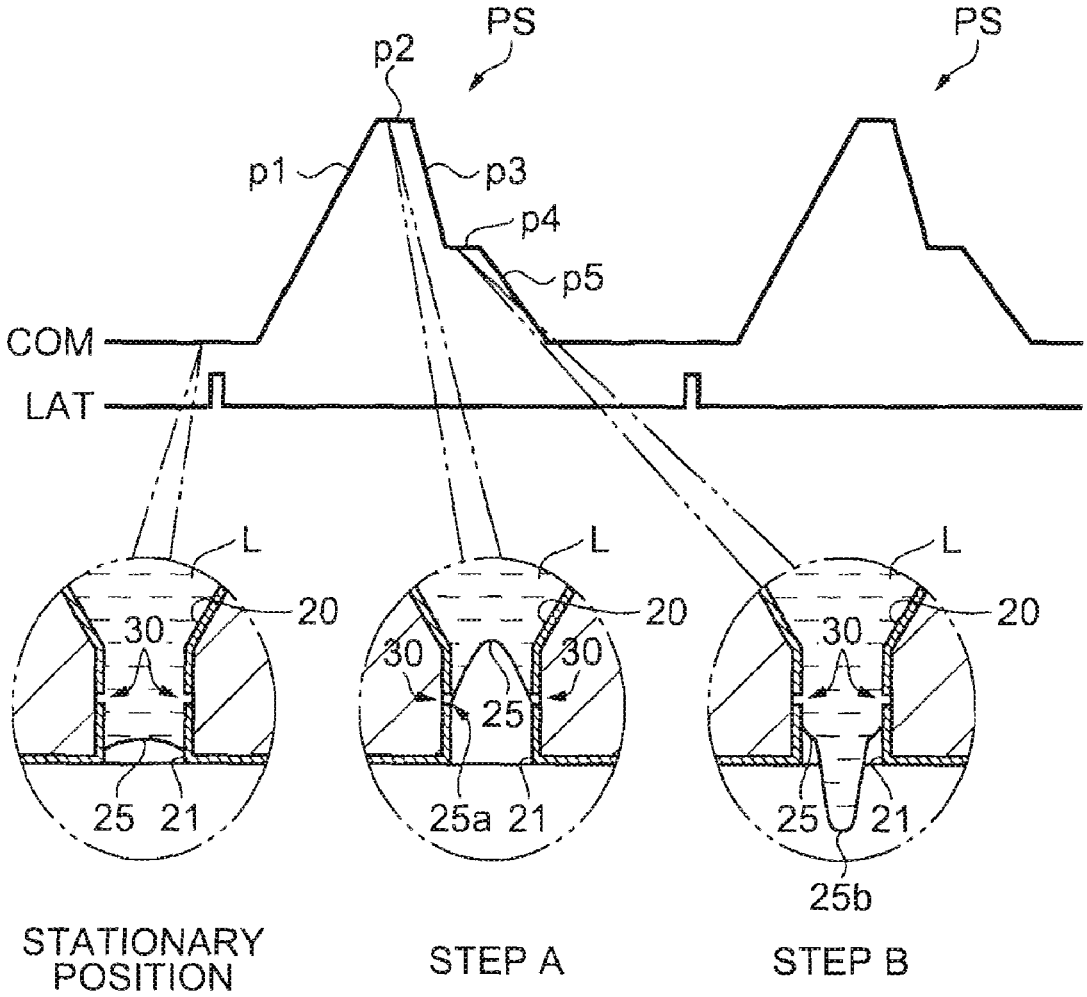
FIG. 5 is a diagram showing a relationship between timing of the drive signal and behavior of the meniscus inside the nozzle.

FIG. 5 is a diagram showing a relationship between timing of the drive signal and behavior of the meniscus inside the nozzle.

The drive signal (COM) shown in FIG. 5 includes a pulse group PS composed of a plurality of pulses, and it is arranged that one droplet is discharged in response to one pulse group PS being supplied to the piezoelectric element 16 (see FIG. 2). The electrical potential of the drive signal (COM) and the displacement of the piezoelectric element 16 are in a substantially linear relationship, and according to the relationship in the droplet discharging head 11 (see FIG. 2) of the present embodiment, the cavity 17 (see FIG. 2) is depressurized when the electrical potential rises, and the cavity 17 is pressurized when the electrical potential is lowered.

The pulse group PS includes a charge pulse p1 for raising the electrical potential, discharge pulses p3, p5 for lowering the electrical potential, and horizontal pulses p2, p4 for connecting these pulses and keeping the electrical potential constant. In the time duration before the pulse group PS is applied, the meniscus 25 in the nozzle 20 is positioned slightly in the back of the nozzle opening 21 (hereinafter, the position is referred to as a stationary position).

If the cavity 17 is depressurized in accordance with the application of the charge pulse p1, the meniscus 25 is deeply pulled in towards the inside (the direction towards the taper section 23 (see FIG. 2) side) of the nozzle 20 from the stationary position (step A). Hereinafter, the position of the meniscus 25 at this moment is referred to as an discharging standby position.

When the cavity 17 is pressurized in response to application of the steep discharge pulse p3 through the horizontal pulse p2, the meniscus 25 is pushed out towards the nozzle opening 21, and the center portion 25*b* of the meniscus 25 protrudes outward from the nozzle opening 21 (step B). The center portion 25*b* of the meniscus 25 is eventually separated from the liquid substance L in the nozzle 20 by the force thereof, and is discharged as a droplet.

The discharge pulse p5 plays a role of returning the electrical potential at the end of the discharge pulse p3 (the horizontal pulse p4) to the electrical potential at the beginning of the pulse group PS. Further, the discharge pulse p5 is designed to be applied with the timing for canceling the residual vibration in order for playing a role of attenuating early the pressure oscillation (residual vibration) inside the cavity 17 and the nozzle 20 caused by the charge pulse p1 and the discharge pulse p3.

In the discharging control described above, the position of the meniscus 25 after applying the charge pulse p1, namely the discharging standby position is an element having a strong relationship with the amount (discharging amount) of the droplet to be discharged. For example, if the discharging standby position is nearer to the inside of the nozzle 20, the discharging amount is relatively reduced, and if the discharging standby position is nearer to the nozzle opening 21, the discharging amount is relatively increased. In other words, it is an important matter for performing the stable discharging control to stabilize the discharging standby position.

The recess section 30 in the nozzle 20 according to the present embodiment is provided in view of such circumstances, and plays a role of regulating moving of the edge 25*a* of the meniscus 25 in that position (depth) when the meniscus 25 is pulled in, and thus stabilizing the discharging standby position. In the discharging control of such a droplet discharging head 11, it is preferable to appropriately design the strength of the charge pulse p1 so that the edge 25*a* of the meniscus 25 after applying the charge pulse p1 is positioned at the forming position (depth) of the recess section 30. Further, in the resent embodiment, it is arranged that the movement of the edge 25*a* of the meniscus 25 is regulated in an isotropic manner by providing the recess section 30 in a circular manner along the inside circumferential direction of the nozzle 20, thus making consideration of not giving bad influence to the shape of the meniscus 25.

Modified Example

Now, a modified example will be explained focusing on the differences from the previous embodiment with reference to FIG. 6.

FIGS. 6A through 6D are cross-sectional views showing a manufacturing process of the nozzle plate according to the modified embodiment.

Figure 6A:
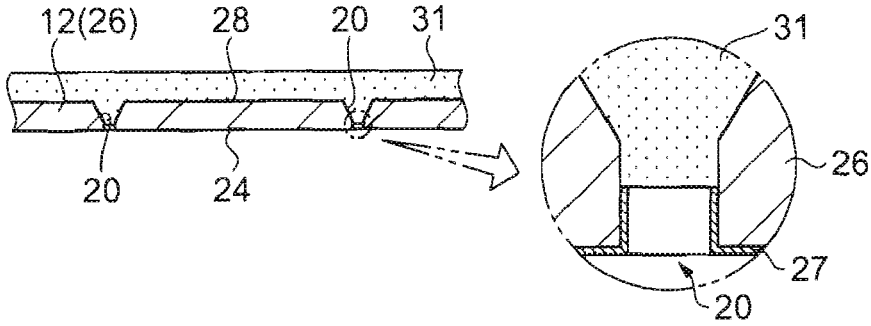
FIGS. 6A through 6D are cross-sectional views showing a manufacturing process of the nozzle plate according to a modified embodiment.
Figure 6B:
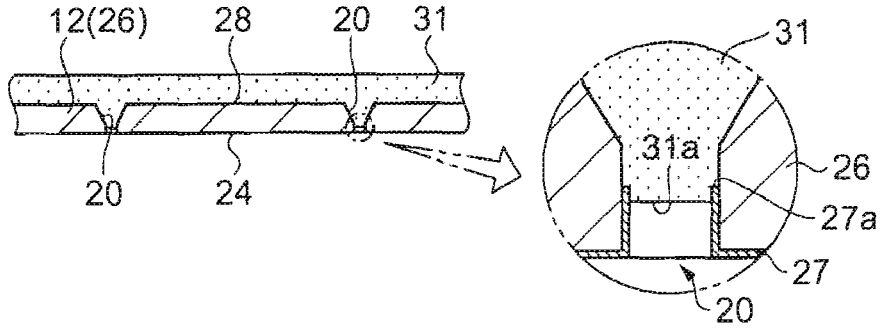
Figure 6C:
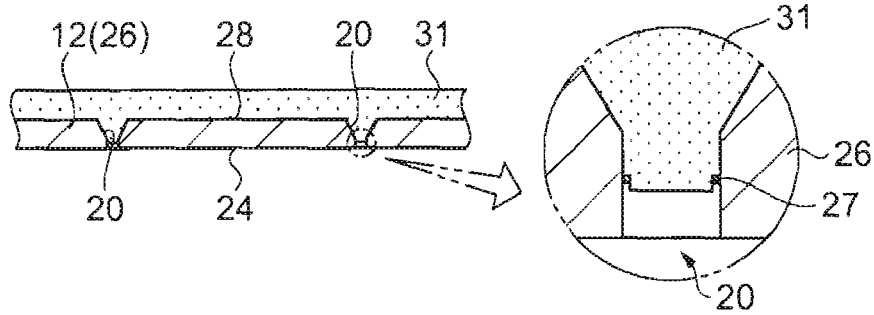
Figure 6D:
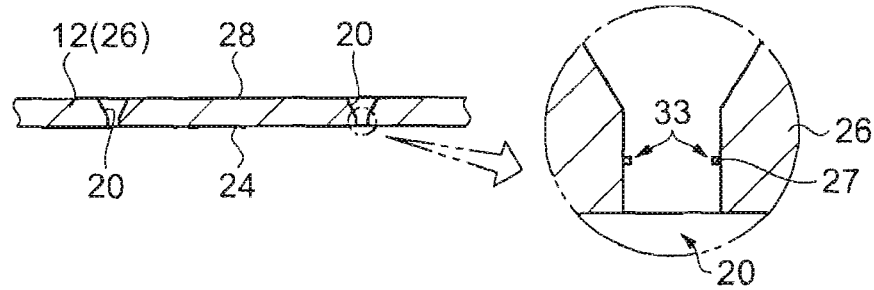

As shown in FIG. 6D, the nozzle 20 of the nozzle plate 12 according to the present modified example is provided with a protruding section 33 as the partially formed surface layer 27. The protruding section 33 plays a role of regulating the movement of the edge of the meniscus in the process of the discharging control similarly to the recess section 30 (see FIG. 5) in the previous embodiment, and forms the meniscus regulating section of the present modified example. The nozzle plate 12 equipped with such a protruding section 33 can be manufactured by a method described below.

Firstly, as shown in FIG. 6A, a resist film 31 is adhered to a taper surface 28 side of the nozzle plate 12 (the base plate 26) provided with the nozzles 20, and the resist film 31 is inserted in the nozzles 20 to a predetermined depth by applying appropriate heat and pressure. Then, after forming the surface layer 27 on the exposed surface of the base plate 26, the resist film 31 is removed.

Subsequently, as shown in FIG. 6B, a resist film 31 is adhered again to the taper surface 28 side of the nozzle plate 12, and the resist film 31 is inserted in the nozzles 20 to a predetermined depth by applying appropriate heat and pressure. In this case, an edge 31*a* of the resist film 31 is inserted to a position covering the edge 27*a* of the surface layer 27 formed in the previous step.

Subsequently, as shown in FIG. 6C, an exposed part of the surface layer 27 is removed by etching, and then the resist film 31 is removed. Further, the lyophobic film is provided to the opening surface 24, thus the nozzle plate 12 as shown in FIG. 6D is completed.

It should be noted that as an application of the process described above, by forming a self-assembling film such as fluoroalkylsilane instead of the surface layer 27 and performing a surface activation process by, for example, Ar plasma irradiation instead of etching, the area corresponding to the protruding section 33 can be made lyophobic, and the area irradiated by the Ar plasma can be made lyophilic. In the nozzle 20 provided with such lyophobic area (lyophobic film), the movement of the edge of the meniscus is also regulated by the boundary between the lyophobic area and the lyophilic area when the meniscus is pulled in, in other words, the meniscus regulating section of the present modified example can be formed also by such a lyophobic area.

As explained hereinabove, the structure, the shape, and so on of the meniscus regulating section according to the embodiments of the invention are not particularly limited providing the meniscus regulating section can regulate the movement of the edge of the meniscus in the inside wall of the nozzle. For example, such a modification as forming the recess section 30 (see FIG. 2) in the previous embodiment to have a shape with a V-shaped cross-section, or forming the protruding section 33 to have a shape with a wedge-shaped cross-section is possible. The meniscus regulating section is preferably a contiguous circular structure. According to this shape, it is possible to uniformly contact the edge of the meniscus, and accordingly, the movement of the meniscus can be stabilized.

Second Embodiment

Now, a second embodiment will be explained focusing on the differences from the first embodiment with reference to FIG. 7.

Figure 7:
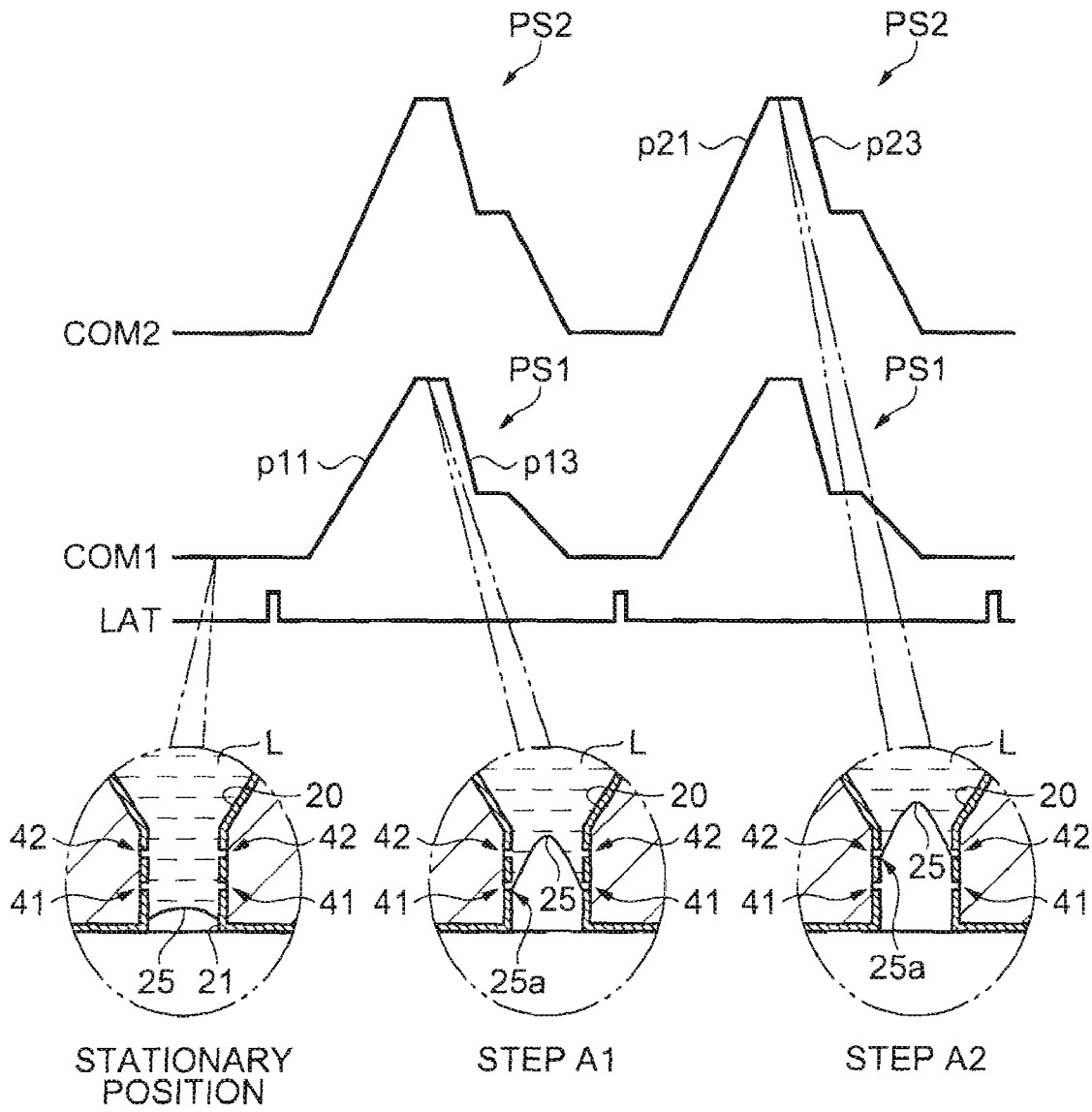
FIG. 7 is a diagram showing a relationship between timing of the drive signal and behavior of the meniscus inside the nozzle according to a second embodiment.

FIG. 7 is a diagram showing a relationship between timing of the drive signal and behavior of the meniscus inside the nozzle according to the second embodiment.

As shown in FIG. 7, the nozzle 20 according to the second embodiment has a first recess section 41 as a first meniscus regulating section and a second recess section 42 as a second meniscus regulating section formed to have depths different from each other. Further, in the second embodiment, there are prepared a first control mode drive signal (COM1) including a pulse group PS1 and a second control mode drive signal (COM2) including a pulse group PS2, and either mode can selectively be used. The pulse group PS1 includes a charge pulse p11 and a discharge pulse p13, and the pulse group PS2 includes a charge pulse p21 and a discharge pulse p23, respectively.

In the first control mode, when the charge pulse p11 is applied, the meniscus 25 is largely pulled in towards the inside of the nozzle 20 from the stationary position (step A1). In this case, the position (depth) of the edge 25*a* of the meniscus 25 becomes the position (depth) at which the first recess section 41 is formed, and the droplet is discharged in response to application of the subsequent discharge pulse p13 (step B1).

In the second control mode, when the charge pulse p21 is applied, the meniscus 25 is largely pulled in towards the inside of the nozzle 20 from the stationary position (step A2). The charge pulse p21 is arranged sufficiently large compared to the charge pulse p11 according to the first control mode, and in this case, the edge 25*a* of the meniscus 25 is pulled in deeper in the back beyond the position (depth) of the first recess section 41, and the movement thereof is regulated at the position of the second recess section 42. Then, the droplet is discharged by application of the subsequent discharge pulse p23 (step B2).

In comparison of the discharging amounts in both of the modes, reflecting the difference in the discharging standby positions of the meniscus 25, the discharging amount according to the second control mode becomes smaller than the discharging amount according to the first control mode. As described hereinabove, according to the second embodiment provided with the meniscus regulating sections at different depths inside the nozzle, it is arranged that the discharging control with high stability can be achieved by the stabilization of the discharging standby positions, and in addition, the discharging amount can be varied in accordance with the modes.

It should be noted that it can be arranged that the first control mode drive signal (COM1) and the second control mode drive signal (COM2) are supplied to the piezoelectric element 16 (see FIG. 3) by switching by the discharging period. Further, it is also possible that the discharging amount is switched in a time-sharing manner by disposing the pulse group PS1 according to the first control mode and the pulse group PS2 according to the second control mode in one drive signal and alternatively selecting either one of the pulse groups.

The invention is not limited to the embodiments described above. Each of the components of the embodiments can be combined with each other appropriately, eliminated, or combined with other components not shown.

What is claimed is:

1. A droplet discharging head comprising:
a nozzle supplied with a liquid substance;
a meniscus moving section that moves a meniscus of the liquid substance in the nozzle; and
a meniscus regulating section that is provided to an inside wall of the nozzle at a predetermined depth from an opening of the nozzle and regulates movement of an edge of the meniscus in the nozzle at the predetermined depth, wherein
the meniscus regulating section includes one of a recess section and a protruding section provided to the inside wall of the nozzle.

2. The droplet discharging head according to claim 1,
the meniscus regulating section being disposed along an inside circumferential direction of the nozzle.

3. The droplet discharging head according to claim 1,
the meniscus regulating section including a lyophobic area provided to the inside wall of the nozzle.

4. The droplet discharging head according to claim 1,
the meniscus regulating section including:
a first meniscus regulating section; and
a second meniscus regulating section disposed at a different depth from the first meniscus regulating section.

5. A droplet discharging device comprising:
the droplet discharging head according to claim 4; and
a discharging control section that controls the meniscus moving section to discharge a droplet from the nozzle,
the discharging control section including:
a first control mode for performing
moving the edge of the meniscus towards the inside of the nozzle to the depth in accordance with the first meniscus regulating section, and
discharging the droplet by moving the meniscus towards the opening of the nozzle;
and
a second control mode for performing
moving the edge of the meniscus towards the inside of the nozzle to the depth in accordance with the second meniscus regulating section, and
discharging the droplet by moving the meniscus towards the opening of the nozzle.

6. A droplet discharging device comprising:
the droplet discharging head according to claim 1; and
a discharging control section that controls the meniscus moving section to discharge a droplet from the nozzle,
the discharging control section performing
moving the edge of the meniscus towards the inside of the nozzle to the predetermined depth in accordance with the meniscus regulating section, and
discharging the droplet by moving the meniscus towards the opening of the nozzle.

7. A droplet discharging head comprising:
a discharging surface provided to a base;
a liquid cavity;
a through hole that is provided to the base and connects the discharging surface and the liquid cavity, the through hole including a first section bordering the discharging surface and a second section bordering the liquid cavity; and a circular meniscus regulating section being provided to an inside wall of the first section, and the meniscus regulating section protruding from and/or is recessed in the inside wall of the first section in a middle from the discharging surface.

8. A method of controlling discharging, comprising:

moving an edge of a meniscus towards an inside of a nozzle to a depth in accordance with a meniscus regulating section that is provided to an inside wall of the nozzle at a predetermined depth from an opening of the nozzle and regulates movement of the edge of the meniscus in the nozzle at the depth and includes one of a recess section and a protruding section provided to the inside wall of the nozzle; and discharging the droplet by moving the meniscus towards the opening of the nozzle after the step of moving the edge of the meniscus.

* * * * *